United States Patent [19]

Bailey

[11] Patent Number: 4,915,257

[45] Date of Patent: Apr. 10, 1990

[54] ROUGH SERVICE PAPER DISPENSERS

[76] Inventor: Curtis C. Bailey, P.O. Box 55, Chico, Calif. 95927

[21] Appl. No.: 180,145

[22] Filed: Apr. 11, 1988

[51] Int. Cl.[4] ..... B65H 19/04

[52] U.S. Cl. ..... 221/48; 70/56; 221/57; 221/34; 242/55.2; 242/55.42; 242/55.3

[58] Field of Search ..... 242/55.2, 55.42, 55.54, 242/55.53; 221/48, 52, 34; 211/5, 17, 20, 22; 70/54, 5 L

[56] References Cited

U.S. PATENT DOCUMENTS

| | | | |
|---|---|---|---|
| 416,433 | 12/1889 | Wilson | 70/56 |
| 1,088,389 | 2/1914 | Wheeler | 221/48 |
| 1,506,190 | 8/1924 | Marcuse | 221/52 |
| 1,744,644 | 1/1930 | Krueger et al. | 221/48 |
| 2,215,053 | 9/1940 | Reese | 242/55.53 |
| 2,553,389 | 1/1946 | Steiner et al. | 242/55.43 |
| 2,616,632 | 8/1947 | Birr et al. | 242/55.43 |
| 2,991,951 | 7/1958 | Carrol | 242/55.42 |
| 3,168,258 | 10/1962 | Swartz | 242/55.42 |
| 3,217,998 | 12/1964 | Swartz | 242/55.42 |
| 3,690,580 | 9/1972 | Jespersen | 242/55.3 |
| 3,736,016 | 5/1973 | Garvey et al. | 70/56 |
| 3,964,611 | 6/1976 | Galen et al. | 211/5 |
| 4,126,228 | 11/1978 | Bala et al. | 211/22 |
| 4,344,583 | 8/1982 | Drum | 242/55.2 |
| 4,369,929 | 1/1983 | Cayer | 242/55.42 |
| 4,375,874 | 3/1983 | Leotta et al. | 242/55.53 X |
| 4,380,160 | 4/1983 | Hoffman | 70/56 |
| 4,463,912 | 8/1984 | Grunerud | 242/55.42 |
| 4,535,612 | 8/1985 | Seremet | 70/56 |
| 4,807,823 | 2/1989 | Wyant | 242/55.53 X |

*Primary Examiner*—Andres Kashnikow
*Assistant Examiner*—Matthew C. Graham

[57] ABSTRACT

Rough duty, vandal resistant paper dispensers for rolled and folded toilet paper and for paper towels are provided in lockable containers. The toilet paper roll dispensers are structured with single-wall square tube housing and with two-piece elongated cylindrical housing. The housings are attached longitudinally vertically inclined directly to or by wall bracket structures to panels or walls. Restrictive dispensing of the lower roll of two vertically stacked rolls of rolled toilet paper is provided through a frontal orifice. Folded toilet paper and paper towels are dispensed from sturdy box-like containers. All dispensers have bottom-positioned padlock compartments for protecting padlocks used to lock the dispensers. The dispensers are designed to be manufactured of 16 gauge steel and heavier and of sturdy space age plastics.

6 Claims, 5 Drawing Sheets

ROUGH SERVICE PAPER DISPENSERS

BACKGROUND OF THE INVENTION

1. Field of the Invention

This invention relates to toilet paper and paper towel dispensers. The present invention is specifically directed towards vandal resistant, lockable dispensers for rolled and folded toilet paper and for paper towels.

2. Description of the Prior Art

Past art patents were examined from a search conducted in the following classes and subclasses:

242/55.42, 55.54, and 55.2.

The following patents were noted as being most pertinent to my invention:

The Steiner et al patent issued on May 15, 1951, patent number 2,553,389, shows a holder for dispensing material in roll form.

Birr et al, was issued patent number 2,616,632, dated Nov. 4, 1952, for an apparatus for dispensing sheet material in roll form.

A patent issued to Carroll on July 11, 1961, patent number 2,991,951, illustrates a triple roll toilet paper dispenser.

Schwartz was granted patent number 3,168,258, on Feb. 2, 1965, for "Dispenser For Rolled Toilet Tissue".

Schwartz was granted another patent on Nov. 16, 1965, patent number 3,217,998, for "Rolled Toilet Tissue Dispenser".

Patent number 3,690,580 was issued to Jespersen on Sept. 12, 1972 illustrates a horizontal feed, rolled toilet paper dispenser.

Drum was granted patent 4,344,583 on Aug. 17, 1982, for a one roll toilet paper holder.

A patent was issued to Grunerud on Aug. 7, 1984, patent number 4,463,912, for a multi-roll dispenser.

To my knowledge, the foregoing patents represented devices most pertinent to my invention. Several types of rolled and folded toilet paper and paper towel dispensers for public facilities have been in use for some time. Although theses toilet paper and paper towel dispensers have had varying degrees of success in the past they have also had their drawbacks. One major problem involved with public rest rooms is the ever increasing vandalism of the toilet paper dispensers. Of the several past art patent devices which do provide lockable containers, none have proven to be very successful in deterring the persistent vandal.

A further disadvantage of the prior art patents is the relatively high cost of manufacture of most of the devices and the poor functional reliability of others. A further drawback is the fact that most conventional toilet paper dispensers used today are sized for a certain diameter of rolled toilet paper, and therefore replacement stock must be purchased from specific, not to mention expensive, suppliers.

My invention overcomes these disadvantages and provides new and useful improvements over the previously mentioned past art patent devices as will be shown in the summary and specification.

SUMMARY OF THE INVENTION

In practicing my invention, I have developed lockable, vanadal resistant toilet paper and paper towel dispensers designed for use in public facilities.

Therefore, it is a primary object of my invention to provide toilet paper and paper towel dispensers having in common a vanadal resistant padlock securing means covered in a protective compartment.

Another object of my invention is to provide toilet paper dispensers which are drip tight or deflects overhead water. When public rest rooms are serviced and cleaned, the walls of the rest rooms are sometimes sprayed with water or fluid cleaner and water collecting on the top of the dispensers leaks down inside and damages the toilet tissue or paper towels. The object is also to prevent this damage.

A further object of my invention is to provide a toilet paper dispenser having automatic dispensing of the second vertically stacked roll of tissue after the first is used.

An even further object of my invention is to provide toilet paper and paper towel dispensers which though very sturdy are simple and reliable in function and have no moveable mechanical apparatus to bind and prevent proper dispensing of the toilet paper or paper towels.

A still further object of my invention is to provide toilet paper and paper towel dispensers which can be manufactured of 16 gauge steel and of heavy duty, durable plastics.

Another object of the invention is to provide toilet paper and paper towel dispensers which will accept and dispense a variety of paper sizes.

Other objects and advantages of my invention will become apparent with a reading of the description of the preferred embodiment along with subsequent comparison with the accompanying drawings and numbered parts list.

DRAWING REFERENCE NUMBERS

Figure 1:
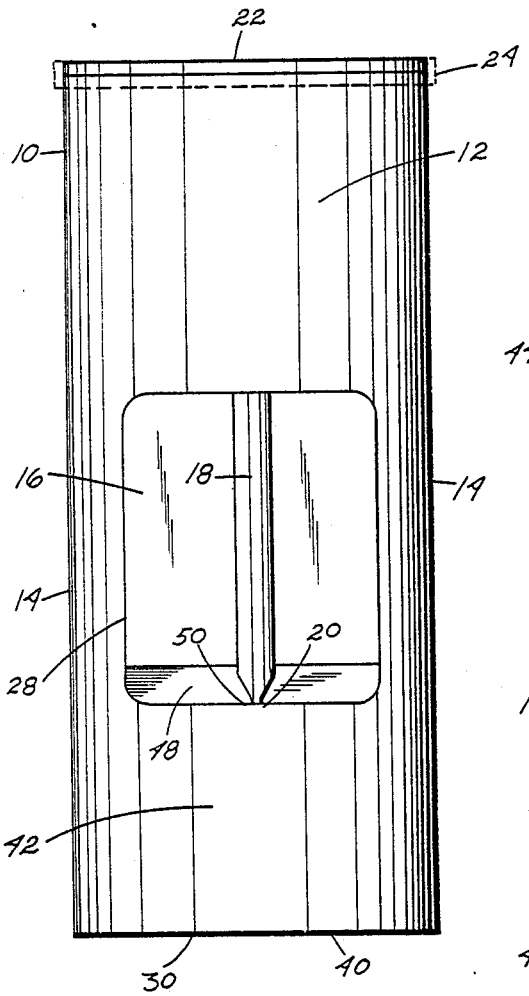
FIG. 1 is a front view of the preferred embodiment illustrating the rounded roll toilet paper dispenser longitudinally vertically oriented in use attitude.

10 rounded roll toilet paper dispenser
12 rounded housing
14 rounded housing side panels
16 bracket wall hanger plate
18 paper roll holder lock rod
20 lock wedge
22 top plate
24 optional cap
26 floor
28 tissue dispenser orifice
30 opened bottom
32 hanger bolt apertures
34 upper housing hanger brace
36 hasp
38 padlock
40 lock security chamber
42 lock security chamber shield
44 hanger plate angled ridge
46 toilet paper rolls
48 lower housing hanger brace
50 hasp slot
52 assemblage directional arrows
54 bridge slot
56 angled top plate lock
58 squared toilet paper dispenser
60 squared housing
62 wall hanger platform
64 hanger attach apertures
66 housing angled hanger platform lock
68 angled platform ridge
70 hanger bolts
72 wall section
74 toilet tissue dispensing slot
76 folded toilet tissue
78 housing hasp plate
80 platform hasp plate
82 housing base
84 platform base
86 rectangular folded paper towel dispenser
88 paper towel dispenser housing
90 towel dispenser hanger platform
92 towel dispenser hanger platform base
94 towel hanger platform attachment apertures
96 towel platform hasp plate
98 towel housing hasp plate
100 folded paper towels
102 paper towel dispensing slot
104 angled towel housing lock
106 towel hanger angled ridge lock
108 rectangular housing base
110 square tubular roll toilet paper dispenser
112 square base platform
114 one-piece square tubular housing
116 heavy duty plastic structure
118 square top plate
120 square optional cap

DESCRIPTION OF THE PREFERRED EMBODIMENTS

Figure 2:
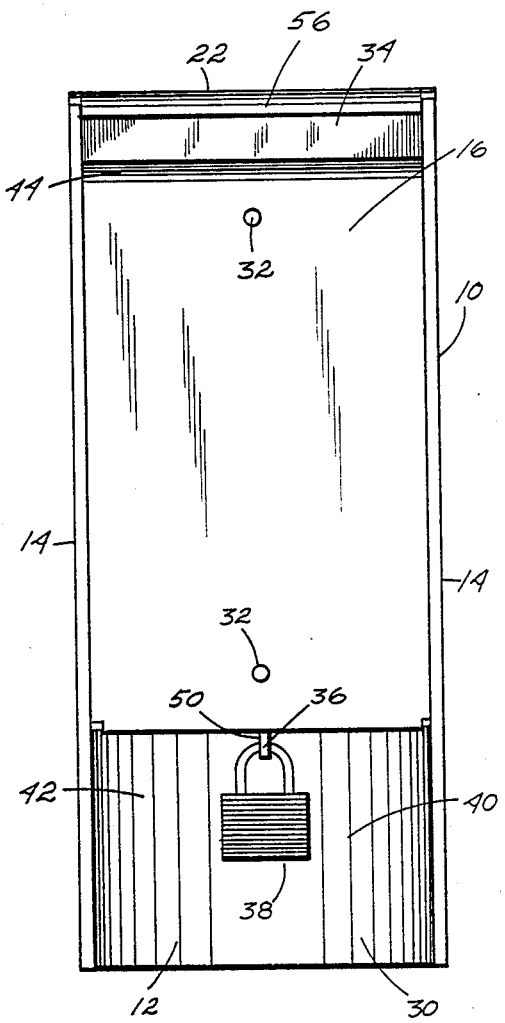
FIG. 2 is a rear view of FIG. 1.

Referring now to the drawings at FIG. 1 and FIG. 2 where the preferred embodiment of the invention, a rounded roll toilet paper dispenser 10 for rough service, is illustrated in front and back views. In the frontal view of FIG. 1, rounded roll toilet paper dispenser 10 is an assemblage of rounded housing 12 frontwardly with rounded housing side panels 14 forming somewhat of a U-shape front to back structure. Wall hanger bracket 16 can be seen through tissue dispenser orifice 28 as can paper roll holder lock rod 18. As illustrated in FIG. 1, paper roll holder lock rod 18 forms downwardly into lock wedge 20. Top plate 22 sets atop of rounded housing 12 and the dotted lines at top plate 22 illustrate the encasing wall of optional cap 24 which can replace top plate 22 if needed. Floor 26, which is a right angled extension of wall hanger bracket 16, is also visible through tissue dispensing orifice 28 in FIG. 1. Rounded roll toilet paper dispenser 10 is illustrated longitudinally vertically aligned in use attitude. Downwardly, the bottom section of rounded housing 12 has an opened bottom 30 formed into lock security chamber 40 and the front skirt area of rounded housing 12 becomes lock security chamber shield 42.

In the back view of FIG. 1 at FIG. 2, the structuring of lock security chamber 40 is best seen. The skirt-like front panel of rounded housing 12 is lock security chamber shield 42 and the opening produced behind lock security chamber shield 42 is lock security chamber 40. A flattened, apertured end of paper roll holder lock rod 18 protruding through hasp slot 50 is formed into hasp 36. Padlock 38 is fastened through the aperture in hasp 36 and rounded roll toilet paper dispenser is securely locked shut. This locking is accomplished by top plate 22 pressing downwardly removably affixed firmly to the upper edge of rounded housing 12 by an underside central attachment to paper roll holder lock rod 18 which in turn is held by padlock 38 under floor 26. Floor 26 is a right angled extension of wall hanger bracket 16 and wall hanger bracket 16 is locked under upper housing hanger brace 34 by hanger plate angled ridge 44 at the upper terminal end. Top plate 22 is also locked over upper housing hanger brace 34 by angled top plate lock 56, the downwardly back edge of top plate 22. In FIG. 2, hanger bolt apertures 32 are shown positioned upwardly and downwardly in a vertical center alignment through the back of back wall hanger plate 16. Padlock 38 is accessible through opened bottom 30 for attachment and removal.

Figures 3, 4, 5, 6:
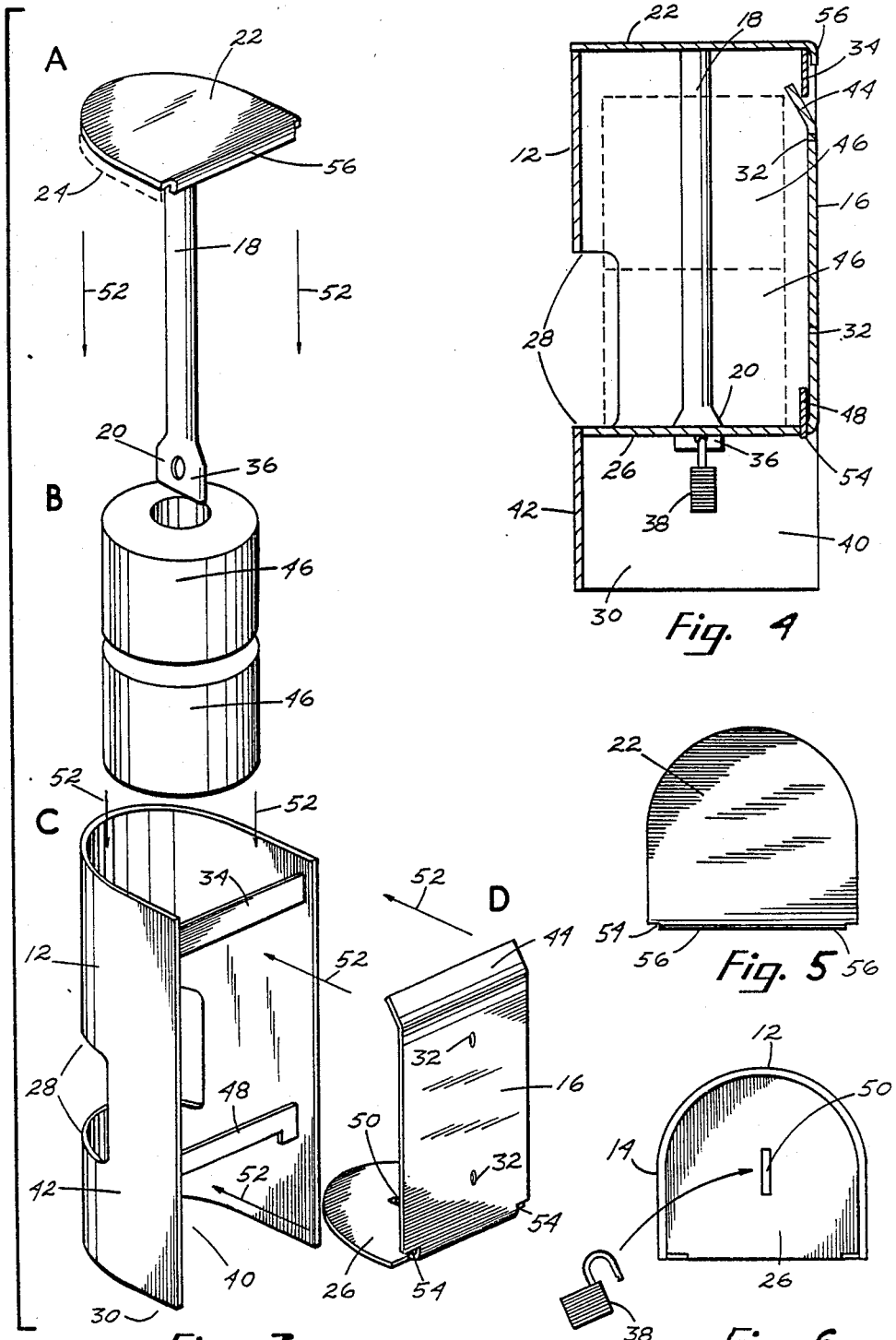
FIG. 3 illustrates the unassembled U shape of the rounded roll toilet paper dispense of the preferred embodiment in an exploded perspective rear view.
FIG. 4 is a cross sectional side view of the rounded roll toilet paper dispenser.
FIG. 5 is a top view of the U-shaped rounded roll toilet paper dispenser.
FIG. 6 is a bottom view of the U-shaped rounded roll toilet paper dispenser.

An exploded view at FIG. 3 best illustrates assembling of rounded roll toilet paper dispenser 10. This is a rough service paper dispenser for use in vandal-prone areas. It is manufactured of a heavy gauge metal (16 gauge steel or heavier) as illustrated in FIG. 3, but durable space-age plastics can also be used as illustrated in the embodiment shown at FIG. 14, and it is to be understood that all embodiments of the rough service paper dispensers described herein can be manufactured of presently known materials both metal and plastic and of more durable materials still under development.

At FIG. 3, paper roll holder lock rod 18 attached centrally to the underside of top plate 22 or optional cap 24 is slid downwardly through the two toilet paper rolls 46. Wall hanger bracket 16 is securely fastened to a wall or a special side panel in public toilet divider stall walls by bolts 70 (FIG. 11) through hanger bolt apertures 32. Rounded housing 12 is attached to wall hanger bracket 16 by positioning upper housing hanger brace 34 above and over hanger plate angle ridge 44. Top plate 22 is brought down and locked to upper housing hanger brace 34 by angled top plate lock 56 which fits in behind upper housing hanger brace 34. Rounded housing 12 is pushed back against wall hanger bracket 16 until floor 26 snaps under lower housing hanger brace 48 the upper edge of which fits into bridge slot 54. Hasp 36 at the end of lock wedged 20 on the lower terminal end of paper roll holder lock rod 18 is pushed through hasp slot 50 in floor 26. Hasp 36 has protruded into lock security chamber 40 and padlock 38 can be attached to the aperture in hasp 36 upwards through opened bottom 30 of rounded housing 12. Thus rounded roll toilet paper dispenser 10 is loaded for use and securely locked by padlock 38 in lock security chamber 40. Assemblage directional arrows 52 indicate direction of assembly for the unmounted parts.

At FIG. 4, a sectional view illustrates a metal application and shows positioning of the various described parts fully mounted. FIG. 5 illustrates the upper surface of top plate 22 and FIG. 6 is a view upward from the bottom of lock security chamber 40 showing hasp slot 50 centered in floor 26 between rounded housing side panels 14 and the rounded front of rounded housing 12. Opened padlock 38 is shown ready for attachment.

Figure 7:
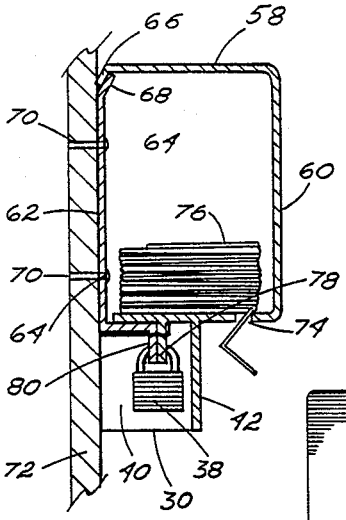
FIG. 7 is a side sectional view of a rectangular embodiment of the invention useful for folded toilet tissue dispensing.
Figure 8:
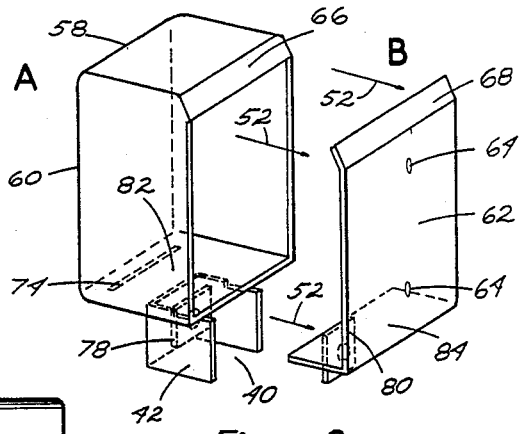
FIG. 8 is a perspective unassembled view of the folded toilet tissue dispensing embodiment.
Figure 9:
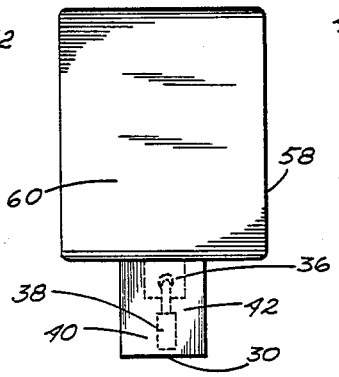
FIG. 9 is a frontal view of the folded toilet tissue embodiment.

FIG. 7, FIG. 8, and FIG. 9 illustrate squared toilet paper dispenser 58, an embodiment of this invention for dispensing folded toilet tissue. In the perspective view of the separated parts at FIG. 8, the squared housing 60 of squared toilet paper dispenser 58 is shown positioned for attachment to wall hanger platform 62. Assemblage directional arrows 52 indicate attach directions when wall hanger platform 62 is mounted to wall section 72 by hanger bolts 70 through hanger attach apertures 64 as shown in FIG. 7. Housing angled hanger platform lock 66 fits over angled platform ridge 68 and platform base 84 slides under housing base 82 to form a flooring support for folded toilet tissue 76. See both FIG. 7 and FIG. 8. The device is locked shut by padlock 38 through the apertures in housing hasp plate 78 and platform hasp plate 80 which come together as the device is assembled. Lock security chamber 40 is similar in all embodiments of the invention. The illustrations at FIGS. 7, 8, and 9, of the squared toilet paper dispenser 58, show how padlock 38 is locked through the formed hasp 36 in lock security chamber 40 protected by U-shaped lock security chamber shield 42 accessible through opened bottom 30. Protected folded toilet tissue 76 is dispensed through toilet tissue dispensing slot 74.

Figure 10:
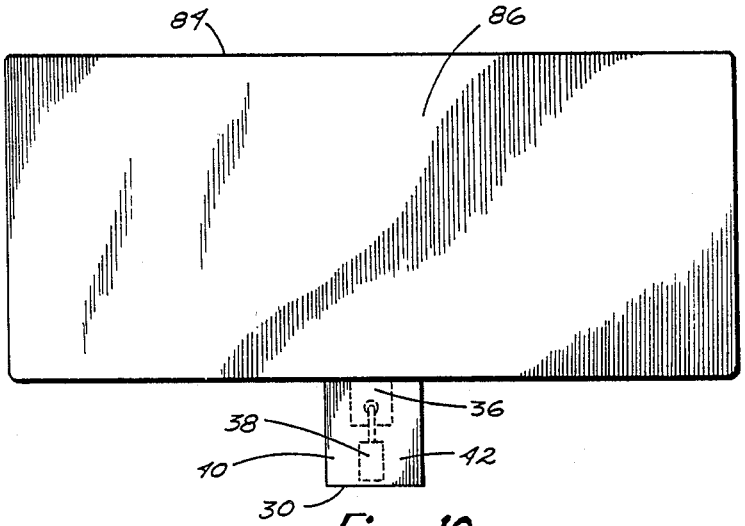
FIG. 10 is a frontal view of the rectangular embodiment of the invention useful for folded paper towel dispensing.
Figure 11:
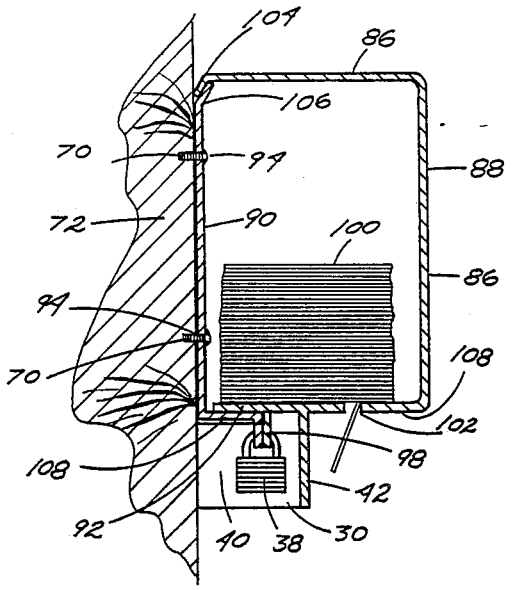
FIG. 11 is a cross sectional side view of the folded paper towel dispenser.
Figure 12:
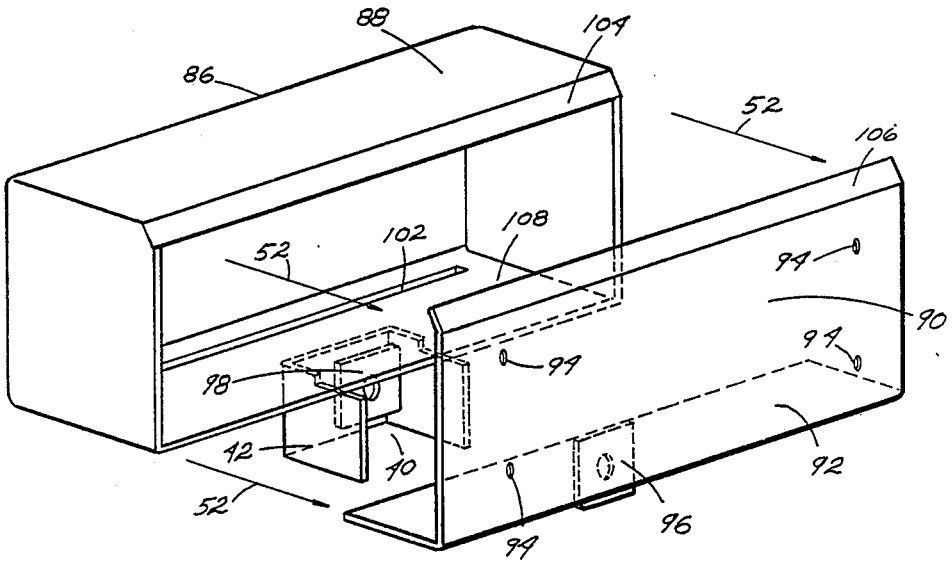
FIG. 12 is a perspective unassembled view of the folded paper towel dispenser.
Figure 13:
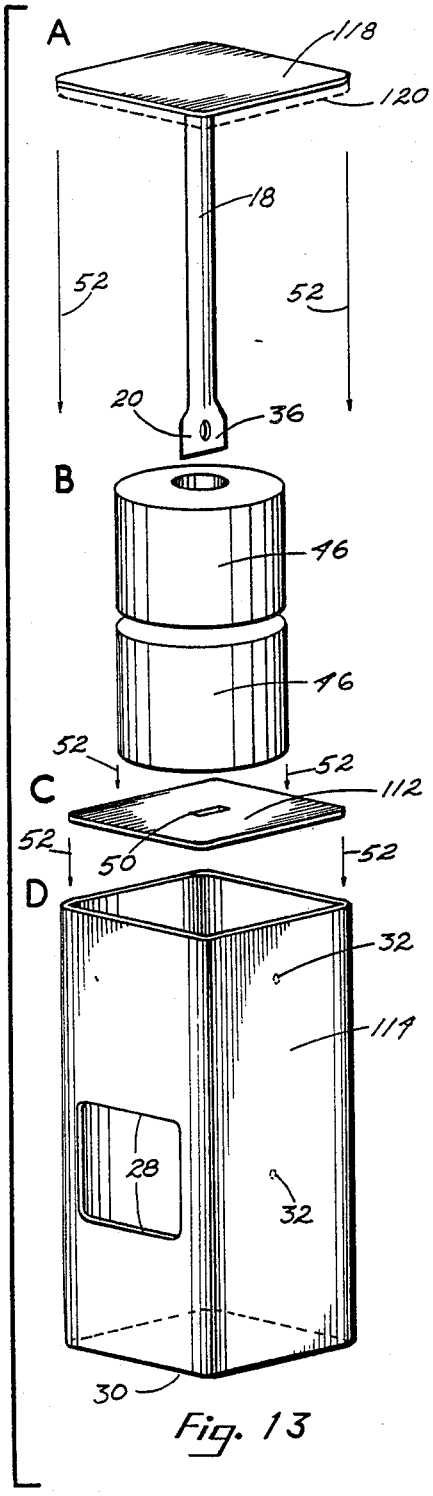
FIG. 13 is an exploded perspective view of a square tubular housed embodiment of the invention longitudinally oriented for roll toilet paper dispensing.

FIG. 10, FIG. 11, and FIG. 12 illustrate an embodiment of the invention for rough service dispensing of paper towels. With slight variations, the attachment method for hanging the housing to the wall hanger is similar in the rounded toilet paper dispenser 10 of FIG. 4, the squared toilet paper dispenser 58 of FIG. 7, and the rectangular folded paper towel dispenser 86 of FIG. 11. It is noted that an important feature used in all embodiments of this invention is the lock security chamber 40. In public facilities, it's common practice for vandals to smash locks on dispensers with a hammer or with anything heavy which can be swung. Padlock 38 in lock security chamber 40 protected by lock security chamber shield 42 not only discourages smashing the lock but using bolt cutters is stopped and picking the lock is made difficult.

In the rectangular folded paper towel dispenser 86 of FIGS. 10, 11, and 12, towel dispenser hanger platform 90 is attached to wall section 72 by hanger bolts 70 through towel hanger platform attachment apertures 94. Paper towel dispenser housing 88 is attached at the top by angled towel housing lock 104 being hooked over towel hanger angled ridge lock 106. Rectangular housing base 108 fits over towel dispenser hanger platform base 92 bringing towel platform hasp plate 96 and towel housing hasp plate 98 together to form hasp 36. U-shaped lock security shield 42 slides against wall section 72 to form lock security chamber 40. Folded paper towels 100 are dispensed through paper towel dispenser slot 102.

Figure 14:
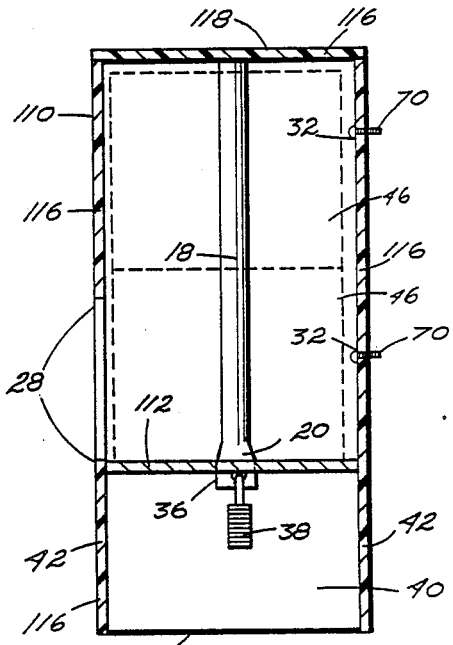
FIG. 14 is a cross sectional side view of the square tubular housed roll toilet paper dispenser of FIG. 13 assembled illustrating heavy duty plastic structure.
Figure 15:
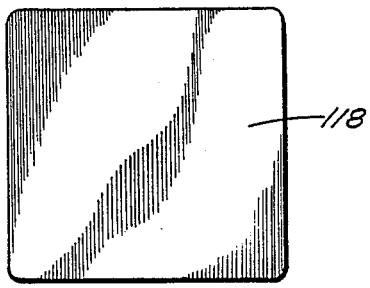
FIG. 15 is a top view of the square tubular housed embodiment of the invention shown at FIG. 13.
Figure 16:
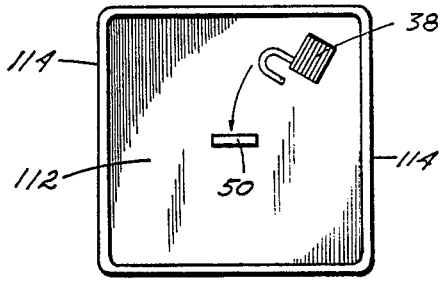
FIG. 16 is a bottom view of FIG. 13.

FIGS. 13, 14, 15, and 16 illustrate an embodiment of the present invention similar to the preferred embodiment illustrated in FIGS. 1 through 6. The main difference is that this embodiment, designated square tubular roll toilet paper dispenser 110, is structured with a one-piece square tubular housing 114 and has a square base plate 112 affixed permanently in the position assumed by floor 26 in the preferred embodiment at FIG. 1. Although square tubular roll toilet paper dispenser 110 is illustrated at FIG. 14 assembled and manufactured in heavy duty plastic structure 116, it is to be understood that all embodiments of the present invention lend themselves to both metal and plastic fabrication.

The assemblage and functional parts of square tubular roll toilet paper dispenser 110 and rounded roll toilet paper dispenser 10 are sufficiently similar that exchangeable parts and structures use the same description numbers in the drawings and specifications. Notable differences are that square tubular roll toilet paper dispenser 110 has a one-piece square tubular housing 114 with square base platform 112 affixed by manufacture or permanent attachment as internal flooring adjacently below tissue dispenser orifice 28. Square top plate 118 is used in this embodiment (FIG. 13) replacing top plate 22 (FIG. 3) and square optional cap 120 replaces optional cap 24. Square tubular roll toilet paper dispenser 110 is illustrated at FIG. 14 fabricated in heavy duty plastic structure 116. One-piece square tubular housing 114 is fastened to a wall or petition by hanger bolts 70 through hanger bolt apertures 32. Paper roll holder lock rod 18 is passed down through the center tubes of toilet paper rolls 46 which rest on square platform base inside one-piece square tubular housing 114 (see FIG. 14). The first roll of toilet paper rolls 46 is available for retrieval through tissue dispensing orifice 28. When the first roll is depleted, the cardboard center tube can be torn from paper roll holder lock rod 18 and the second roll of toilet paper 46 drops down and is availale through tissue dispenser orifice 28. Both toilet roll dispenser embodiments of the present invention operate in this same manner. Assembled (FIG. 14), paper roll holder lock rod 18 is attach centraly to square top plate 118 at one end and locked under square base platform 112 at the other end by padlock 38 in hasp 36 formed below lock wedge 20 in the lower terminal end of paper roll holder lock rod 18. The locked padlock 38 is concealed in lock security chamber 40 covered by a lower section of one-piece square tubular housing 114 which forms lock security chamber shield 42. Access to padlock 38 is only through the opened bottom 30 of one-piece square tubular housing 114. It is noted that the hasp is designated hasp 36 both as a single end piece of a center rod or in a two-piece structure.

For resupplying, in both embodiments of the toilet paper roll dispensers, padlock 38 is unlocked and removed, the top plate, 22 or 118, is pulled upward until paper roll holder lock rod 18 is clear. Two toilet paper rolls 46 with center tubes vertically aligned are dropped into one-piece squared tubular housing 114. Paper roll holder lock rod 18 is passed through the aligned center tubes and hasp 36 passes through hasp slot 50 in square base platform 112. Padlock 38 is locked into hasp 36 below squared base platform 112 and square tubular roll toilet paper dispenser is secured and ready for service. The embodiment of FIGS. 1 through 6 is reloaded in a similar manner. In both the squared toilet paper dispenser 58 and the rectangular folded paper towel dispenser 86, padlock 38 is unlocked and the housing is removed from the wall hanger. Folded toilet tissue 76 or folded paper towels 100 are loaded into their respective housing and the housing is rehung as previously described. Padlock 38 is locked into the formed hasp 36 and the dispensers are secured, loaded, and ready for use.

Although I have described various embodiments of my rough service paper dispensers with considerable details in the specifications, it is to be understood that in practice I may somewhat alter the design and structure of the devices so long as any changes made remain within the intended scope of the appended claims.

What I claim is:

1. A vandal resistant rough service rest room paper dispenser adapted by internally concealed retainers for attachment to a vertical surface and being comprised of detachable members with said members interlocking and maintained interlocked temporarily by a locking means shielded in a shrouded compartment, said interlocking members forming a housing, said housing having a frontal containment member attachable by said interlocking to a backing member with said backing member provided with said retainers for attaching said dispenser to said vertical surface;

an opening in said frontal housing compartment member for dispensing said rest room paper therefrom with said opening sized according to said rest room paper dispensing requirements;

said shrouded lock compartment being formed by walls of said housing extending below a rest room paper support flooring in said housing with said extending walls providing an opened bottom skirting having cooperative components arranged shielded inside said skirting for attachment of a padlock providing said locking means for maintaining said members temporarily interlocked forming said housing.

2. The rest room paper dispenser of claim 1 wherein said housing has said frontal containment member substantially U-shaped and said backing member substantially rectangular providing said housing in a form particularly adapted for longitudinal vertical attachment to said vertical surface and for dispersement of said rest room paper as toilet paper rolls stacked vertically aligned edgewise one above the other and retained mobile by a removable center rod with a lower end of said rod flattened and passed through a slot in said rest room paper support flooring with said lower end of said rod apertured for removable attachment by a padlock being said locking means shielded in said shrouded compartment formed by walls of said housing extending below said rest room paper support flooring in said housing.

3. The rest room paper dispenser of claim 1 wherein said housing is shaped in a substantially square tubular form arranged for longitudinal vertical dispersement of said rest room paper as roll toilet paper vertically stacked edgewise retained mobile by a center rod with a lower end of said rod flattened and passed through a slot in said rest room paper support flooring with said lower end of said rod apertured for removable attachment by a padlock being said locking means shielded in said shrouded compartment formed by walls of said housing extending below said rest room paper support flooring in said housing.

4. The rest room paper dispenser of claim 1 wherein said housing has said frontal compartment member formed box-like substantially elongated rectangular with said backing member being a substantially rectangular plate, said housing arranged for longitudinal horizontal attachment to said vertical surface and having a right angled lower end base section adapted for lock attachment to a lock plate affixed under said rest room paper support flooring inside said shrouded compartment, said frontal containment box-like member arranged for said dispersement of said rest room paper in elongated rectangular folded paper form, there being said opening in said frontal housing containment member for said dispensing said rest room paper therefrom opened downwards in said frontal housing containment member, said opening sized according to said rest room paper dispensing requirements with those requirements being an elongated slot.

5. The rest room paper dispenser of claim 1 wherein said housing has said frontal containment member formed box-like in a substantially square configuration with said backing member being a substantially square plate having a right angled lower end base section adapted for lock attachment to a lock plate affixed under said rest room paper support flooring inside said shrouded compartment with said frontal containment box-like member arranged for said dispersement of said rest room paper in substantially square folded paper form, there being said opening in said frontal housing containment member for said dispensing said rest room paper therefrom opened downwards in said frontal housing containment member, said opening sized according to said rest room paper dispensing requirements with those requirements being an elongated slot.

6. The rest room paper dispenser of claim 1 wherein said vandal resistant rough service rest room paper dispenser is structured of heavy gauge steel.

* * * * *